US011437054B2

(12) United States Patent
Appleton et al.

(10) Patent No.: US 11,437,054 B2
(45) Date of Patent: Sep. 6, 2022

(54) SAMPLE-ACCURATE DELAY IDENTIFICATION IN A FREQUENCY DOMAIN

(71) Applicant: Dolby Laboratories Licensing Corporation, San Francisco, CA (US)

(72) Inventors: Nicholas Luke Appleton, Rosebery (AU); Shanush Prema Thasarathan, North Parramatta (AU)

(73) Assignee: DOLBY LABORATORIES LICENSING CORPORATION, San Francisco, CA (US)

( * ) Notice: Subject to any disclaimer, the term of this patent is extended or adjusted under 35 U.S.C. 154(b) by 72 days.

(21) Appl. No.: 17/022,423

(22) Filed: Sep. 16, 2020

(65) Prior Publication Data

US 2021/0082449 A1 Mar. 18, 2021

Related U.S. Application Data

(60) Provisional application No. 63/068,071, filed on Aug. 20, 2020, provisional application No. 62/901,345, filed on Sep. 17, 2019.

(51) Int. Cl.

| | |
|---|---|
| ***G10L 21/0224*** | (2013.01) |
| ***G10L 19/008*** | (2013.01) |
| ***G10L 21/0216*** | (2013.01) |

(52) U.S. Cl.

CPC ..... *G10L 21/0224* (2013.01); *G10L 19/008* (2013.01); *G10L 2021/02165* (2013.01)

(58) Field of Classification Search

CPC ..... G10L 19/008; G10L 21/0224; G10L 2021/02165

See application file for complete search history.

(56) References Cited

U.S. PATENT DOCUMENTS

| | | | |
|---|---|---|---|
| 7,742,592 | B2 | 6/2010 | Faller |
| 8,213,598 | B2 | 7/2012 | Bendersky |
| 8,731,207 | B2 | 5/2014 | Kuech |
| 8,804,977 | B2 | 8/2014 | Neal |
| 9,113,240 | B2 | 8/2015 | Ramakrishnan |
| 9,191,519 | B2 | 11/2015 | Kawabata |
| 9,641,952 | B2 | 5/2017 | Fejzo |
| 9,654,894 | B2 | 5/2017 | Nesta |
| 9,947,338 | B1 | 4/2018 | Koteshwara |
| 10,009,478 | B2 | 6/2018 | Mani |

(Continued)

*Primary Examiner* — Daniel R Sellers

(57) ABSTRACT

Systems, methods, and computer program products for frequency-domain estimation of latency between audio signals. In some embodiments, the estimation is performed on first blocks of data indicative of samples of a first audio signal and second blocks of data indicative of samples of a second audio signal, and includes determining a coarse latency estimate, including by determining gains which, when applied to some of the second blocks, determine estimates of one of the first blocks, and identifying one of the estimates as having a best spectral match to said one of the first blocks. A refined latency estimate is determined from the coarse estimate and some of the gains. Optionally, at least one metric indicative of confidence in the refined latency estimate is generated. Audio processing (e.g., echo cancellation) may be performed on the frequency-domain data, including by performing time alignment based on the refined latency estimate.

23 Claims, 4 Drawing Sheets

(56) References Cited

U.S. PATENT DOCUMENTS

| | | | | |
|---|---|---|---|---|
| 10,339,954 | B2 | 7/2019 | Kamdar | |
| 2006/0140392 | A1* | 6/2006 | Ahmadi | H04B 3/23 379/406.1 |
| 2014/0003635 | A1* | 1/2014 | Mohammad | G10K 11/16 381/306 |
| 2015/0249885 | A1* | 9/2015 | Kawabata | H04B 3/231 381/66 |
| 2016/0134759 | A1* | 5/2016 | Mani | H04B 3/237 379/406.08 |
| 2019/0090061 | A1 | 3/2019 | Seldess | |
| 2019/0156852 | A1 | 5/2019 | Shi | |

* cited by examiner

SAMPLE-ACCURATE DELAY IDENTIFICATION IN A FREQUENCY DOMAIN

CROSS-REFERENCE TO RELATED APPLICATION

This application claims the benefit of U.S. Provisional Patent Application No. 62/901,345, filed Sep. 17, 2019, and U.S. Provisional Patent Application No. 63/068,071, filed Aug. 20, 2019, which are incorporated herein by reference.

FIELD OF INVENTION

This disclosure generally relates to audio signal processing. Some embodiments pertain to estimating time delay to be applied to an audio signal relative to another audio signal, in order to time-align the signals (e.g., to implement echo cancellation or other audio processing on the signals).

BACKGROUND

Echo cancellation technologies can produce problematic output when the microphone signal is ahead of the echo signal, and they generally function better when the microphone input signal and the echo signal are roughly time-aligned. It would be useful to implement a system that can identify a latency between the signals (i.e., a time delay which should be applied to one of the signals relative to the other one of the signals, to time-align the signals) in order to allow improved implementation of echo cancellation (or other audio processing) on the signals.

An echo cancellation system may operate in the time domain, on time-domain input signals. Implementing such systems may be highly complex, especially where long time-domain correlation filters are used, for many audio samples (e.g., tens of thousands of audio samples), and may not produce good results.

Alternatively, an echo cancellation system may operate in the frequency domain, on a frequency transform representation of each time-domain input signal (i.e., rather than operating in the time-domain). Such systems may operate on a set of complex-valued band-pass representations of each input signal (which may be obtained by applying a STFT or other complex-valued uniformly-modulated filterbank to each input signal). For example, US Patent Application Publication No. 2019/0156852, published May 23, 2019, describes echo management (echo cancellation or echo suppression) which includes estimating (in the frequency domain) delay between two input audio streams. The echo management (including the delay estimation) implements adaptation of a set of predictive filters.

However, the need to adapt a set of predictive filters (e.g., using a gradient descent adaptive filter method) adds complexity to estimation of time delay between audio signals. It would be useful to estimate time delay between audio signals in the frequency domain without the need to perform adaptation of predictive filters.

NOTATION AND NOMENCLATURE

Throughout this disclosure including in the claims, the term "heuristic" is used to denote based on trial and error (e.g., to achieve good results at least in contemplated or typical conditions) or experimentally determined (e.g., to achieve good results at least in contemplated or typical conditions). For example, a "heuristic" value (e.g., parameter or metric) may be experimentally determined (e.g., by tuning), or may be determined by a simplified method which, in general, would determine only an approximate value, but in the relevant use case determines the value with adequate accuracy. For another example, a "heuristic" value for processing data may be determined by at least one statistical characteristic of the data, which is expected (based on trial and error, or experiment) to achieve good results in contemplated use cases. For another example, a metric (e.g., a confidence metric) may be referred to as a "heuristic" metric if the metric has been determined based on trial and error or experiment to achieve good results at least in contemplated or typical conditions.

Throughout this disclosure including in the claims, the term "latency" of (or between) two audio signals (e.g., time-domain audio signals, or frequency-domain audio signals generated by transforming time-domain audio signals) is used to denote the time delay which should be applied to one of the signals, relative to the other one of the signals, in order to time-align the signals.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X−M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio data). Examples of processors include a field-programmable gate array (or other configurable integrated circuit or chip set), a digital signal processor programmed and/or otherwise configured to perform pipelined processing on audio data, a graphics processing unit (GPU) configured to perform processing on audio data, a programmable general purpose processor or computer, and a programmable microprocessor chip or chip set.

Throughout this disclosure including in the claims, the term "couples" or "coupled" is used to mean either a direct or indirect connection. Thus, if a first device is said to be coupled to a second device, that connection may be through a direct connection, or through an indirect connection via other devices and connections.

Throughout this disclosure including in the claims, "audio data" denotes data indicative of sound (e.g., speech) captured by at least one microphone, or data generated (e.g., synthesized) so that said data are renderable for playback (by at least one speaker) as sound (e.g., speech). For example, audio data may be generated so as to be useful as a substitute for data indicative of sound (e.g., speech) captured by at least one microphone.

SUMMARY

A class of embodiments of the invention are methods for estimating latency between audio signals, using a frequency transform representation of each of the signals (e.g., from frequency-domain audio signals generated by transforming time-domain input audio signals). The estimated latency is an estimate of the time delay which should be applied to one of the audio signals (e.g., a pre-transformed, time-domain audio signal) relative to the other one of the audio signals (including any time delay applied to the other one of the signals) to time-align the signals, e.g., in order to implement contemplated audio processing (e.g., echo cancellation) on at least one of the two signals. In typical embodiments, the latency estimation is performed on a complex-valued frequency bandpass representation of each input signal (which may be obtained by applying a STFT or other complex-valued uniformly-modulated filterbank to each input signal). Typical embodiments of the latency estimation are performed without the need to perform adaptation of predictive filters.

Some embodiments of the latency estimation method are performed on a first sequence of blocks, M(t,k), of frequency-domain data indicative of audio samples of a first audio signal (e.g., a microphone signal) and a second sequence of blocks, P(t,k), of frequency-domain data indicative of audio samples of a second audio signal (e.g., a playback signal) to estimate latency between the first audio signal and the second audio signal, where t is an index denoting time, and k is an index denoting frequency bin, said method including steps of:

(a) for each block P(t,k) of the second sequence, where t is an index denoting the time of said each block and k is an index denoting frequency bin, providing delayed blocks, P(t,b,k), where b is an index denoting block delay time, where each value of index b is an integer number of block delay times by which a corresponding one of the delayed blocks is delayed relative to the time t;

(b) for each block, M(t,k), determining a coarse estimate, $b_{best}(t)$, of the latency at time t, including by determining gains which, when applied to each of the delayed blocks, P(t,b,k), determine estimates, $M_{est}(t,b,k)$, of the block M(t,k), and identifying one of the estimates, $M_{est}(t,b,k)$, as having a best spectral match to said block, M(t,k), where the coarse estimate, $b_{best}(t)$, has accuracy on the order of one of the block delay times; and (c) determining a refined estimate, R(t), of the latency at time t (e.g., $R(t)=L_{med}(t)$, as in an example embodiment described herein), from the coarse estimate, $b_{best}(t)$, and some of the gains (e.g., using properties of a time-domain-to-frequency-domain transform which has been applied to generate the blocks M(t,k) and the blocks P(t,k)), where the refined estimate, R(t), has accuracy on the order of an audio sample time (e.g., in the case that the frequency-domain data have been generated by applying a time-domain-to-frequency-domain transform to time-domain data, the audio sample time is the sample time of the pre-transformed data).

In some embodiments, at least one of the coarse estimate or the refined estimate of latency is determined using one or more heuristically determined parameter. For example, in some embodiments step (b) includes determining a heuristic unreliability factor, U(t,b,k), on a per frequency bin basis (e.g., for a selected subset of a full set of the bins k) for each of the delayed blocks, P(t,b,k). In some such embodiments, gains H(t,b,k) are the gains for each of the delayed blocks, P(t,b,k), and each said unreliability factor, U(t,b,k), is determined from sets of statistical values, said sets including mean values, $H_m(t,b,k)$, determined from the gains H(t,b,k) by averaging over two times (the time, t, and a previous time, t−1); and variance values $H_v(t,b,k)$, determined from the gains H(t,b,k) and the mean values $H_m(t,b,k)$ by averaging over the times t and t−1.

In some embodiments, step (b) includes determining goodness factors, Q(t,b), which may be determined heuristically, for the estimates $M_{est}(t,b,k)$ for the time t and each value of index b, and determining the coarse estimate, $b_{best}(t)$, includes selecting a best one (e.g., the smallest one) of the goodness factors, Q(t,b).

In some embodiments, the method also includes steps of: (d) applying thresholding tests to determine whether a candidate refined estimate of the latency (e.g., a most recently determined value L(t) as in some example embodiments described herein) should be used to update a previously determined refined estimate R(t) of the latency; and (e) using the candidate refined estimate to update the previously determined refined estimate R(t) of the latency only if the thresholding tests determine that thresholding conditions are met. Typically, step (d) includes determining whether a set of smoothed gains $H_s(t, b_{best}(t), k)$, for the coarse estimate, $b_{best}(t)$, should be considered as a candidate set of gains for determining an updated refined estimate of the latency. In some embodiments which include steps (d) and (e), the method also includes a step of determining a fourth best coarse estimate, $b_{4tbbest}(t)$, of the latency at time t, and step (b) includes determining goodness factors, Q(t,b), for the estimates $M_{est}(t,b,k)$ for the time t and each value of index b, and determining the coarse estimate, $b_{best}(t)$, includes selecting a best one (e.g., the smallest one) of the goodness factors, Q(t,b), and step (d) includes applying the thresholding tests to the goodness factor $Q(t,b_{best})$ for the coarse estimate $b_{best}(t)$, the goodness factor $Q(t,b_{4thbest})$ for the fourth best coarse estimate, $b_{4thbest}(t)$, and the estimates $M_{est}(t,b_{best},k)$ for the coarse estimate, $b_{best}(t)$.

For example, refined estimates R(t) may be determined for a sequence of times t, from the sets of gains $H_s(t, b_{best}(t), k)$ which meet the thresholding conditions, and step (e) may include identifying a median of a set of X (e.g., X=40) values as the refined estimate R(t) of latency, where the X values include the most recently determined candidate refined estimate and a set of X−1 previously determined refined estimates of the latency.

Typical embodiments of the invention avoid use of a separate time-domain correlation filter and instead attempt to estimate the latency in a frequency domain in which contemplated audio processing is being (or is to be) performed. Typically, the estimated latency (between two audio signals) is expected to be used to time-align the signals, in order to implement contemplated audio processing (e.g., echo cancellation) on the aligned signals. For example, the contemplated audio processing may be performed on the output of a DFT modulated filterbank (e.g., an STFT or other uniformly modulated complex-filterbank), which is a common signal representation employed in audio processing systems, and thus performing the latency estimation in the same domain as the contemplated audio processing reduces the complexity required for the latency estimation.

Some embodiments estimate the latency with accuracy on the order of an individual sample time of pre-transformed (time-domain) versions of the input signals. For example, some embodiments implement a first stage which determines the latency coarsely (on the order of a block of the frequency-domain data which have been generated by applying a time-domain-to-frequency-domain transform on the input signals), and a second stage which determines a sample-accurate latency which is based in part on the coarse latency determined in the first stage.

Some embodiments also generate at least one confidence metric indicative of confidence in the accuracy of the estimated latency. For example, the confidence metric(s) may be generated using statistics over a period of time, to provide at least one indication as to whether the latency calculated at the current time can be trusted. The confidence metric(s) may be useful, for example, to indicate whether the estimate latency is incorrect to a degree that is not correctable, so that other operations (for example, disabling an acoustic echo canceller) or audio processing functions should be performed.

Aspects of the invention include a system configured (e.g., programmed) to perform any embodiment of the inventive method or steps thereof, and a tangible, non-transitory, computer readable medium which implements non-transitory storage of data (for example, a disc or other tangible storage medium) which stores code for performing (e.g., code executable to perform) any embodiment of the inventive method or steps thereof. For example, embodiments of the inventive system can be or include a programmable general purpose processor, digital signal processor, GPU, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto. Some embodiments of the inventive system can be (or are) implemented as a cloud service (e.g., with elements of the system in different locations, and data transmission, e.g., over the internet, between such locations).

DETAILED DESCRIPTION

Figure 1:
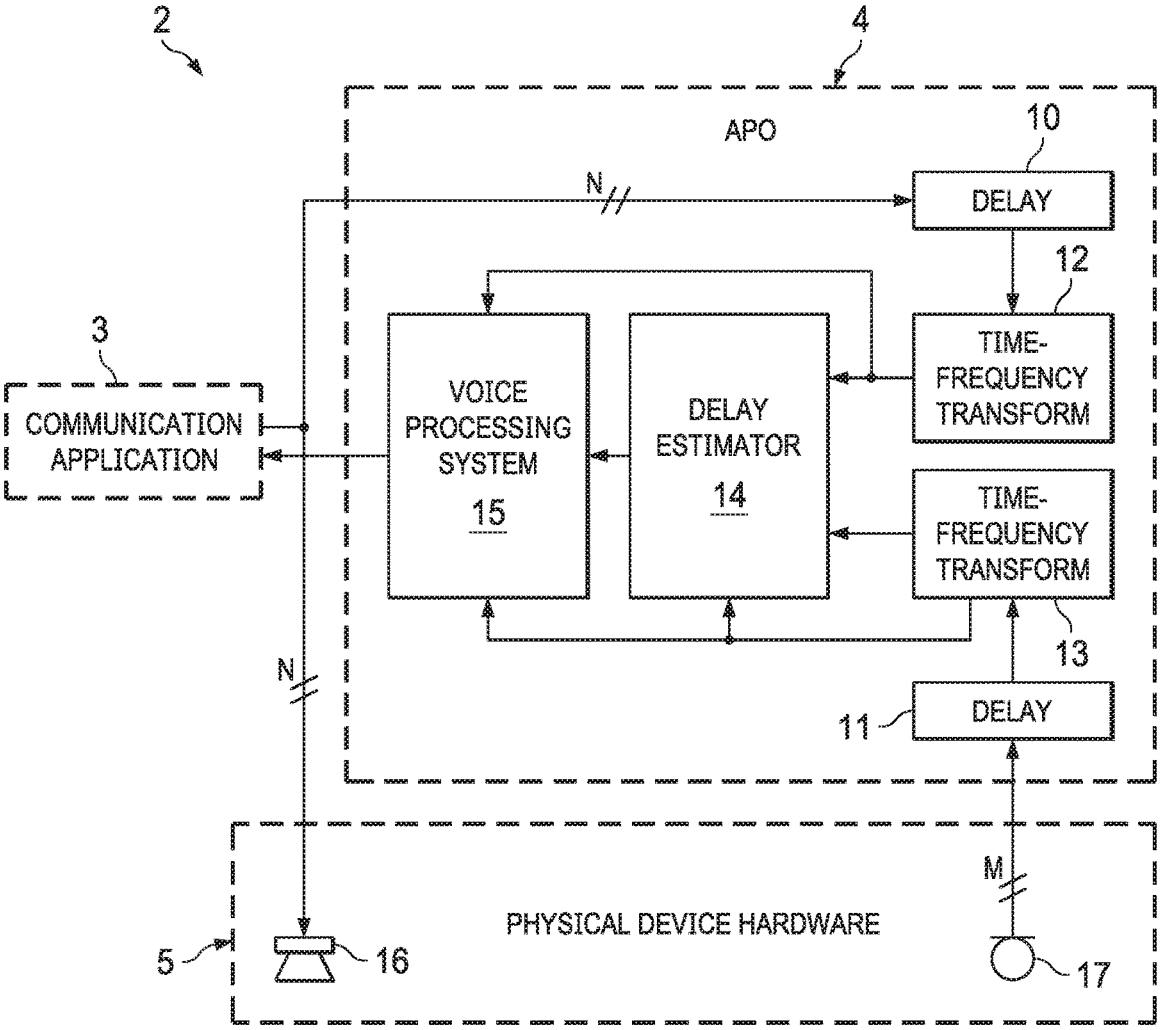
FIG. 1 is a block diagram of an embodiment of the inventive time delay estimation system integrated into a communications system.

FIG. 1 is a block diagram of an embodiment of the inventive time delay estimation system integrated into a communications system. Communications system 2 of FIG. 1 may be a communication device including a processing subsystem (at least one processor which is programmed or otherwise configured to implement communication application 3 and audio processing object 4), and physical device hardware 5 (including loudspeaker 16 and microphone 17) coupled to the processing subsystem. Typically, system 2 includes a non-transitory computer-readable medium which stores instructions that, when executed by the at least one processor, cause said at least one processor to perform an embodiment of the inventive method.

Audio processing object (APO) 4 is implemented (i.e., at least one processor is programmed to execute APO 4) to perform an embodiment of the inventive method for estimating the latency between two audio streams, where the latency is the time delay which should be applied to one of the streams relative to the other one of the streams, in order to time-align the streams. As implemented in system 2, the audio streams are: a playback audio stream (an audio signal) provided to a loudspeaker 16, and a microphone audio stream (an audio signal) output from microphone 17. APO 4 is also implemented (i.e., it includes voice processing subsystem 15 which is implemented) to perform audio processing (e.g., echo cancellation and/or other audio processing) on the audio streams. Although subsystem 15 is identified as a voice processing subsystem, it is contemplated that in some implementations, subsystem 15 performs audio processing (e.g., preprocessing, which may or may not include echo cancellation, for communication application 3 or another audio application) which is not voice processing. Detecting the latency between the streams in accordance with typical embodiments of the invention (e.g., in environments where the latency cannot be known in advance) is performed in an effort to ensure that the audio processing (e.g., echo cancellation) by subsystem 15 will operate correctly.

APO 4 may be implemented as a software plugin that interacts with audio data present in system 2's processing subsystem. The latency estimation performed by APO 4 may provide a robust mechanism for identifying the latency between the microphone audio stream (a "capture stream" being processed by APO 4) and the "loopback" stream (which includes audio data output from communication application 3 for playback by loudspeaker 16), to ensure that echo cancellation (or other audio processing) performed by subsystem 15 (and audio processing performed by application 3) will operate correctly.

In FIG. 1, APO 4 processes M channels of audio samples of the microphone output stream, on a block-by-block basis, and N channels of audio samples of the playback audio stream, on a block-by-block basis. In a typical implementation, delay estimation subsystem 14 of APO 4 estimates the latency between the streams with per-sample accuracy (i.e., the latency estimate is accurate to on the order of individual pre-transformed audio sample times (i.e., sample times of the audio prior to transformation in subsystems 12 and 13), rather than merely on the order of individual blocks of the samples).

In a typical implementation, APO 4 (i.e., delay estimation subsystem 14 of APO 4) estimates the latency in the signal domain in which audio processing (e.g., in subsystem 15) is already operating. For example, both subsystems 14 and 15 operate on frequency-domain data output from time-domain-to-frequency-domain transform subsystems 12 and 13. Each of subsystems 12 and 13 may be implemented as a DFT modulated filterbank (e.g., an STFT or other uniformly modulated complex-filterbank), so that the signals output therefrom have a signal representation often employed in audio processing systems (e.g., typical implementations of subsystem 15), and so that performing the latency estimation in this domain reduces the complexity required for implementing APO 4 to perform the latency estimation (in subsystem 14) as well as the audio processing in subsystem 15.

Typical embodiments described herein (e.g., latency estimation by typical implementations of APO 4 of FIG. 1) are methods for robustly (and typically, efficiently and reliably)

identifying latency of or between input audio signals, using a frequency-domain representation of the input audio signals, with accuracy on the order of an audio sample time of the frequency-domain audio data. Such embodiments typically operate in a blocked audio domain (e.g., a complex-valued, blocked transform domain) in which streams of frequency-domain audio data streams, including blocks of the frequency-domain audio data, are present. The estimated latency is an estimate of the time delay which should be applied to one of the signals, relative to the other one of the signals, in order to time-align the signals, and can be used to compensate for a time delay between two sources of audio. Some embodiments also generate at least one "confidence" metric (e.g., one or more of below-described heuristic confidence metrics $C_1(t)$, $C_2(t)$, and $C(t)$) indicative of confidence that the latency estimate is accurate at a given point in time. The confidence metrics (sometimes referred to as confidence measures) may be used to correct for a latency change in a system (if the latency is dynamic) or to inform the system that operating state or conditions are not ideal and perhaps should adapt in some way (for example, by disabling features being implemented by the system).

As indicated in FIG. 1, APO 4 includes (implements) delay lines 10 and 11, time domain-to-frequency-domain transform subsystems 12 and 13, delay estimation subsystem 14, and voice processing subsystem 15. Delay line 10 stores the last N1 blocks of the time-domain playback audio data from application 3, and delay line 11 stores the last N2 blocks of the time-domain microphone data, where N1 and N2 are integers and N1 is greater than N2.

Time-domain-to-frequency-domain transform subsystem 12 transforms each block of playback audio data output from line 10, and provides the resulting blocks of frequency-domain playback audio data to delay estimation subsystem 14. In typical implementations APO 4 (e.g., subsystem 12 thereof) implements data reduction in which only a subset of a full set of frequency bands (sub-bands) of the frequency-domain playback audio data are selected, and only the audio in the selected subset of sub-bands are used for the delay (latency) estimation.

Time domain-to-frequency-domain transform subsystem 13 transforms each block of microphone data output from line 11, and provides the resulting blocks of frequency-domain microphone data to delay estimation subsystem 14. In typical implementations APO 4 (e.g., subsystem 13 thereof) implements data reduction in which only a subset of a full set of frequency bands (sub-bands) of the frequency-domain playback audio data are selected, and only the audio in the selected subset of sub-bands are used for the delay (latency) estimation.

Subsystem 14 of APO 4 estimates the latency between the microphone and playback audio streams. Some embodiments of the latency estimation method are performed on a first sequence of blocks, M(t,k), of frequency-domain microphone data (output from transform subsystem 13) and a second sequence of blocks, P(t,k), of frequency-domain playback audio data (output from transform subsystem 12), where t is an index denoting a time of each of the blocks, and k is an index denoting frequency bin. In these embodiments, the method includes:

(a) for each block P(t,k) of the second sequence, providing delayed blocks, P(t,b,k), where b is an index denoting block delay time, where each value of index b is an integer number of block delay times by which a corresponding one of the delayed blocks is delayed relative to the time t (e.g., transform subsystem 12 provides to subsystem 14 a number, N1-N2, of delayed blocks P(t,b,k), each having different value of index b, for each block of playback audio data input to delay line 10. Each block of playback audio data input to delay line 10 corresponds to a block M(t,k) of microphone data input to delay line 11); and (b) for each block, M(t,k), determining a coarse estimate, $b_{best}(t)$, of the latency at time t, including by determining gains which, when applied to each of the delayed blocks, P(t,b,k), determine estimates, $M_{est}(t,b,k)$, of the block M(t,k), and identifying one of the estimates, $M_{est}(t,b,k)$, as having a best spectral match to said block, M(t,k), where the coarse estimate, $b_{best}(t)$, has accuracy on the order of one of the block delay times; and (c) determining a refined estimate, R(t), of the latency at time t (e.g., $R(t)=L_{med}(t)$, as in an example embodiment described below with reference to FIG. 2), from the coarse estimate, $b_{best}(t)$, and some of the gains (e.g., using properties of a time-domain-to-frequency-domain transform which has been applied in subsystems 12 and 13 to generate the blocks M(t,k) and the blocks P(t,k)), where the refined estimate, R(t), has accuracy on the order of an audio sample time.

In some embodiments, subsystem 14 uses heuristics to determine the coarse estimate $b_{best}(t)$. For example, in some embodiments performance of step (b) by subsystem 14 includes determining a heuristic unreliability factor, U(t,b,k), on a per frequency bin basis (e.g., for a selected subset of a full set of the bins k) for each of the delayed blocks, P(t,b,k). In some such embodiments, gains H(t,b,k) are the gains for each of the delayed blocks, P(t,b,k), and each said unreliability factor, U(t,b,k), is determined from sets of statistical values, said sets including mean values, $H_m(t,b,k)$, determined from the gains H(t,b,k) by averaging over two times (the time, t, and a time, t−1); and variance values $H_v(t,b,k)$, determined from the gains H(t,b,k) and the mean values $H_m(t,b,k)$ by averaging over the two times.

In some embodiments, performance of step (b) by subsystem 14 includes determining goodness factors, Q(t,b), for the estimates $M_{est}(t,b,k)$ for the time t and each value of index b, and determining the coarse estimate, $b_{best}(t)$, includes selecting a best one (e.g., the smallest one) of the goodness factors, Q(t,b), e.g., as described below with reference to FIG. 2.

During performance of some embodiments of the method, subsystem 14 also performs steps of:

(d) applying thresholding tests to determine whether a candidate refined estimate of the latency (e.g., a most recently determined value L(t) as described below with reference to FIG. 2) should be used to update a previously determined refined estimate R(t) of the latency; and (e) using the candidate refined estimate to update the previously determined refined estimate R(t) of the latency only if the thresholding tests determine that thresholding conditions are met.

Example implementations of steps (d) and (e) are described below with reference to FIG. 2. Typically, step (d) includes determining (in subsystem 14) whether a set of smoothed gains $H_s(t, b_{best}(t), k)$, for the coarse estimate, $b_{best}(t)$, should be considered as a candidate set of gains for determining an updated refined estimate of the latency.

In some embodiments which include steps (d) and (e), the method also includes a step of determining a fourth best coarse estimate, $b_{4tbbest}(t)$, of the latency at time t, and step (b) includes determining goodness factors, Q(t,b), for the estimates $M_{est}(t,b,k)$ for the time t and each value of index b, and determining the coarse estimate, $b_{best}(t)$, includes selecting a best one (e.g., the smallest one) of the goodness factors, Q(t,b), and step (d) includes applying the thresholding tests to the goodness factor $Q(t,b_{best})$ for the coarse estimate $b_{best}(t)$, the goodness factor $Q(t,b_{4thbest})$ for the fourth best coarse estimate, $b_{4thbest}(t)$, and the estimates $M_{est}(t,b_{best},k)$ for the coarse estimate, $b_{best}(t)$.

For example, refined estimates R(t) may be determined for a sequence of times t, from the sets of gains $H_s(t, b_{best}(t), k)$ which meet the thresholding conditions, and step (e) may include identifying a median of a set of X (e.g., X=40) values as the refined estimate R(t) of latency, where the X values include the most recently determined candidate refined estimate and a set of X−1 previously determined refined estimates of the latency.

During performance of some embodiments of the method, subsystem 14 also generates and outputs (e.g., provides to subsystem 15) at least one confidence metric indicative of confidence in the accuracy of the estimated latency. For example, the confidence metric(s) may be generated using statistics over a period of time, to provide at least one indication as to whether the latency calculated at the current time can be trusted. The confidence metric(s) may be useful, for example, to indicate whether the estimate latency is untrustworthy, so that other operations (for example, disabling an acoustic echo canceller) or audio processing functions should be performed. Examples of generation of the confidence metrics are described below with reference to FIG. 2.

Figure 2:
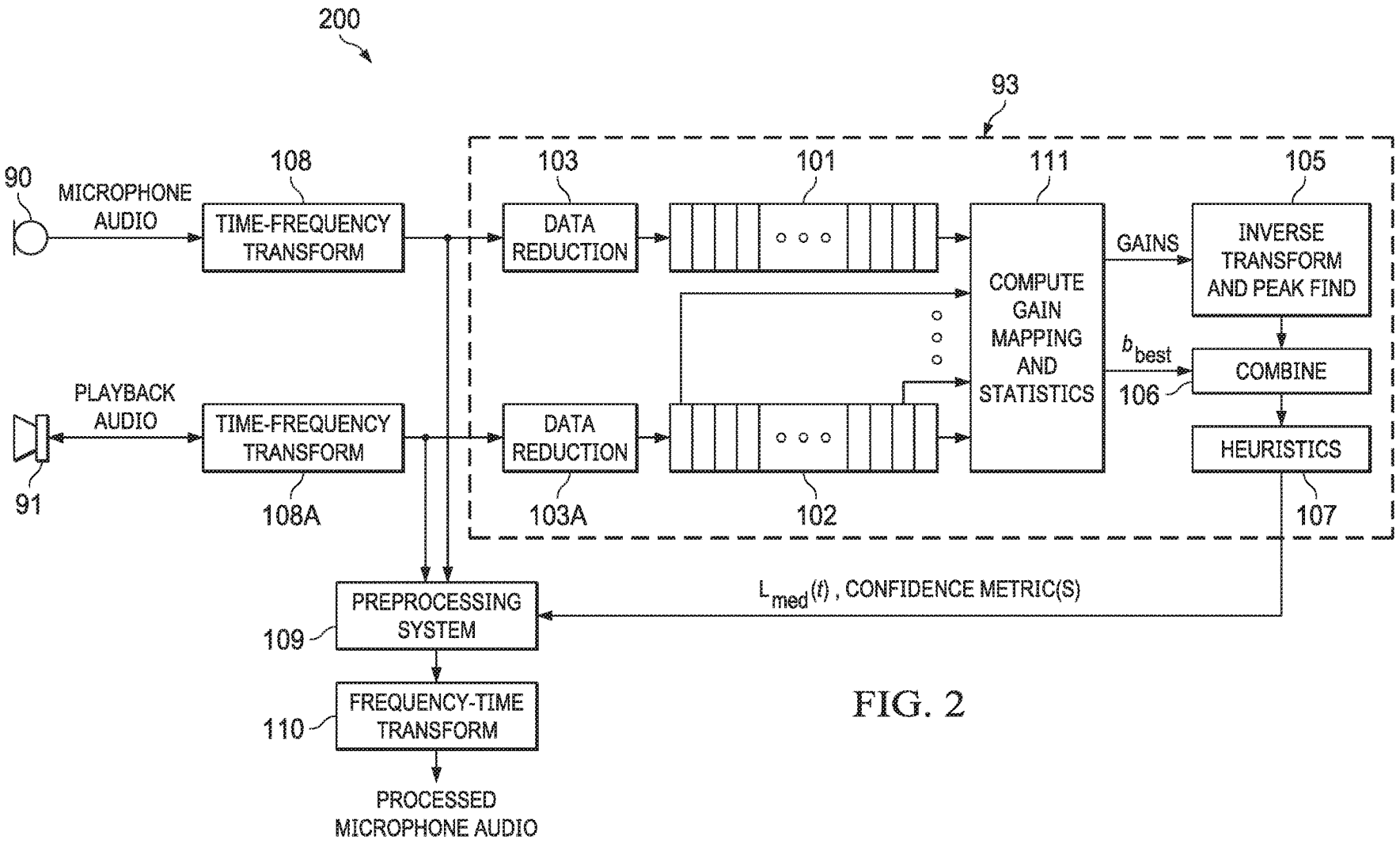
FIG. 2 is a block diagram of an example system configured to perform delay identification in a frequency domain.

FIG. 2 is a block diagram of an example system 200 configured to perform delay identification in a frequency domain. The system of FIG. 2 is coupled to (e.g., includes) microphone 90, loudspeaker 91, and two time domain-to-frequency-domain transform subsystems 108 and 108A, coupled as shown. The system of FIG. 2 includes latency estimator 93, preprocessing subsystem 109, and frequency-domain-to-time-domain transform subsystem 110, coupled as shown. An additional subsystem (not shown in FIG. 2) may apply an adjustable time delay to each of the audio streams to be input to the time-domain-to-frequency-domain transform subsystems 108, e.g., when the elements shown in FIG. 2 are included in a system configured to implement the delay adjustments.

Preprocessing subsystem 109 and frequency-domain-to-time-domain transform subsystem 110, considered together, are an example implementation of voice processing system 15 of FIG. 1. The time-domain audio signal which is output from subsystem 110 is a processed microphone signal which may be provided to a communication application (e.g., application 3 of FIG. 1) or may otherwise be used. Optionally, a processed version of the playback audio signal is also output from subsystem 110.

Latency estimator 93 (indicated by a dashed box in FIG. 2) includes subsystems 103, 103A, 101, 102, 111, 105, 106, and 107, to be described below. The inputs to data reduction subsystems 103 and 103A are complex-valued transform-domain (frequency domain) representations of two audio data streams. In the example shown in FIG. 2 (but not in other contemplated embodiments of latency estimation in accordance with the invention), a time-domain playback audio stream is provided as an input to loudspeaker 91 as well as to an input of transform subsystem 108A, and the output of subsystem 108A is one of the frequency domain audio data streams provided to latency estimator 93. In the example, the other frequency domain audio data stream provided to latency estimator 93 is an audio stream output from microphone 90, which has been transformed into the frequency domain by transform subsystem 108. In the example, the microphone audio data (the output of microphone 90 which has undergone a time-to-frequency domain transform in subsystem 108) is sometime referred to as a first audio stream, and the playback audio data is sometimes referred to as a second audio stream.

Latency estimator (latency estimation subsystem) 93 is configured to compute (and provide to preprocessing subsystem 109) a latency estimate (i.e., data indicative of a time delay, with accuracy on the order of individual sample times, between the two audio data streams input to subsystem 93), and at least one confidence measure regarding the latency estimate. In the FIG. 2 embodiment (and other typical embodiments of the invention), the latency estimation occurs in two stages. The first stage determines the latency coarsely (i.e., subsystem 111 of subsystem 93 outputs coarse latency estimate $b_{best}(t)$ for time t), with accuracy on the order of a block of the frequency-domain data which are input to subsystem 93. The second stage determines a sample-accurate latency (i.e., subsystem 107 of subsystem 93 outputs refined latency estimate $L_{med}(t)$ for time t), which is based in part on the coarse latency determined in the first stage.

Time domain-to-frequency-domain transform subsystem 108 transforms each block of microphone data, and provides the resulting blocks of frequency-domain microphone data to data reduction subsystem 103. Subsystem 103 performs data reduction in which only a subset of the frequency bands (sub-bands) of the frequency-domain microphone audio data are selected, and only the selected subset of sub-bands are used for the latency estimation. We describe below aspects of typical implementations of the data reduction.

Time-domain-to-frequency-domain transform subsystem 108A transforms each block of playback audio data, and provides the resulting blocks of frequency-domain playback audio data to data reduction subsystem 103A. Subsystem 103A performs data reduction in which only a subset of the frequency bands (sub-bands) of the frequency-domain playback audio data are selected, and only the selected subset of sub-bands are used for the latency estimation. We describe below aspects of typical implementations of the data reduction.

Subsystem 111 (labeled "compute gain mapping and statistics" subsystem in FIG. 2) generates the coarse latency estimate ($b_{best}(t)$ for time t), and outputs the coarse latency estimate to subsystem 106. Subsystem 111 also generates, and outputs to subsystem 105, the gain values $H_s(t, b_{best}(t), k)$) for the delayed block (in delay line 102) having the delay index $b_{best}(t)$.

Inverse transform and peak determining subsystem 105 performs an inverse transform (described in detail below) on the gain values $H(t, b_{best}, k)$ generated in subsystem 111, and determines the peak value of the values resulting from this inverse transform. This peak value, the below-discussed value, $$\underset{n\in\left[-\frac{M}{2}-\gamma,\frac{M}{2}+\gamma\right]}{\operatorname{argmax}}\left|\Sigma_{k=0}^{K-1}H_s(t,\ b_{best}(t),k)e^{\frac{j2\pi(n+\alpha)(k+\beta)}{K}}\right|,$$

is provided to subsystem 106.

Combining subsystem 106 generates the below-described latency estimate L(t) from the coarse estimate, $b_{best}(t)$ and the peak value provided by subsystem 105, as described below. The estimate L(t) is provided to subsystem 107.

Subsystem 107 (labeled "heuristics" in FIG. 2) determines the final (refined) latency estimate, $L_{med}(t)$, from the estimate L(t), as described below. Under some conditions (described below), the median of the X (e.g., X=40) most recent values of L(t), is the final (refined) latency estimate, $L_{med}(t)$. Subsystem 107 also generates one or more heuristic confidence metrics (e.g., the confidence metrics $C_1(t)$ and $C_2(t)$ and C(t) described below). The final latency estimate and each confidence metric are provided to preprocessing subsystem 109.

We next describe elements of the FIG. 2 system in greater detail.

Data reduction subsystems 103 and 103A (of FIG. 2) filter the frequency-domain audio streams which enter latency estimation subsystem 93. Specifically, each of subsystems 103 and 103A selects a subset of frequency bands (sub-bands) of the audio data input thereto. Subsystem 103 provides each block of the selected sub-bands of the microphone signal to delay line 101. Subsystem 103A provides each block of the selected sub-bands of the playback signal to delay line 102. The sub-bands which are selected are typically at frequencies which the system (e.g., microphone 90 and loudspeaker 91 thereof) is known to be able to both capture and reproduce well. For example, if the system is implemented in or on a device with small speakers, the selected subset may exclude frequencies which correspond to low-frequency information. The indices of the sub-bands which are selected need not be consecutive and, rather, it is typically beneficial for them to have some diversity (as will be described below). The number of sub-bands which are selected (and thus the number of corresponding frequency band indices which are used for the latency estimation) may be equal or substantially equal to 5% of the total number of frequency sub-bands of the data streams output from each of subsystems 108 and 108A.

Subsystem 93 of FIG. 2 stores the last N1 blocks of the data-reduced first audio stream (data-reduced microphone data) in delay line 101, where N1 is a tuning parameter. In an example, N1=20. The number N1 may be based on configuration of each filterbank employed in the relevant implementation of subsystem 108, with the number (e.g., N1=20) of blocks chosen so that delay line 101 holds a desired amount of audio data (e.g., at least substantially 400 milliseconds of audio data). Other values of N1 are possible. The introduction of latency by using delay line 101 allows the system to detect acausality, which may occur where a given signal appears in the microphone data before it appears in the playback data. Acausality may occur in the system, where (for example) additional processing blocks (not shown in FIG. 2) are employed to process the playback audio provided to the loudspeaker (e.g., before it is transformed in the relevant time-domain-to-frequency-domain transform subsystem 108) and the latency estimation subsystem 93 does not (e.g., cannot) know about such additional processing.

Subsystem 93 also implements delay line 102 which is used to store the last N2 blocks of the data-reduced second audio stream (data-reduced playback data). Delay line 102 has length equal to N2 blocks, where N2 is (at least approximately) equal to twice the length (N1 blocks) of the microphone delay line 101. In the example in which N1=20 blocks, N2=40 blocks is an example of the tuning parameter N2. Other values of N2 are possible.

For every block of delayed audio in line 102, subsystem 111 of the FIG. 2 system computes a set of gains which map the playback audio P(b, k) to the longest delayed block of the microphone data M(t, k) in line 101:

$$H(t, b, k) = \frac{M(t, k)\overline{P}(t-b, k)}{P(t-b, k)\overline{P}(t-b, k) + \varepsilon}$$

where t denotes the point in time that the latency estimation subsystem 93 was called, and increments on every call to the latency estimation system; b denotes the block index of each block of data in delay line 102; and k denotes the frequency bin. The real valued parameter E serves two purposes: to prevent division by zero when the playback audio is zero and to set a threshold beyond which we do not wish to compute reliable gains.

The gains (H(t,b,k)) computed can be invalid in scenarios when one audio stream is only partly correlated with the other audio stream (for example in a duplex communication case, during double talk or near-end only talk). To help identify if a gain is valid, subsystem 111 preferably computes some statistics on a per-frequency-bin basis. Specifically, subsystem 111 computes a mean and variance estimate on each gain of each block:

$$H_m(t,b,k)=\alpha H_m(t-1,b,k)+(1-\alpha)H(t,b,k)$$

$$H_{vinst}(t,b,k)=|H(t,b,k)-H_m(t-1,b,k)|^2$$

$$H_v(t,b,k)=\beta H_v(t-1,b,k)+(1-\beta)H_{vinst}(t,b,k)$$

If the variance is very small, we can conclude that the microphone audio M and playback audio P are closely related, and that P is much greater than ε. If the variance is high, we can conclude that either P is much smaller than ε and the variance is that of M/ε or that P and M are not well correlated.

Subsystem 111 encodes these values into a heuristic "unreliability factor" for each gain:

$$U(t, b, k) = 1 - \frac{P(t-b, k)\overline{P}(t-b, k)}{P(t-b, k)\overline{P}(t-b, k) + \varepsilon} \frac{(1-\beta)H_{vinst}(t, b, k)}{H_v(t, b, k)}$$

This expression can be shown to vary between 0 (indicating excellent mapping between M and P) and 1 (indicating poor mapping between M and P). A thresholding operation is implemented (where ρ is the threshold) on U(t,b,k) to determine if each gain H(t,b,k) should be smoothed into a set of actual mapping estimates, and smoothing is performed only on gains that are valid and reliable. The following equation describes the thresholding operation (where p is the threshold) on U(t,b,k) to determine if a gain H(t,b,k) should be used to generate a set of smoothed gains $H_s(t,b,k)$ which are used to determine a microphone signal estimate, $M_{est}(t, b,k)$, where the smoothing occurs constantly over time, for all time intervals in which U(t,b,k) is lower than the threshold:

$$H_s(t, b, k) = \begin{cases} \gamma H_s(t, b, k) + (1-\gamma)H(t, b, k), & U(t, b, k) < \rho \\ H_s(t, b, k), & U(t, b, k) \geq \rho \end{cases}$$

where ρ is chosen as part of a tuning process. An example value is ρ=0.05.

Once this process has been completed, subsystem 111 determines an estimate of the microphone signal based on the smoothed gains for every delayed gain block:

$$M_{est}(t,b,k)=H_s(t,b,k)P(t-b,k)$$

We wish to identify which set of smoothed gains map their corresponding block of delayed audio (in delay line 102) to the microphone signal M(k). The corresponding block index of the delayed block (in line 102), referred to as $b_{best}(t)$, is used as the coarse estimate of the latency. In order to efficiently and reliably determine the coarse latency estimate, subsystem 111 preferably computes a power estimate of the error, the predicted spectrum and the actual microphone signal:

$$E_{mic}(t, b) = \sum_k |M_{est}(t, b, k) - M(t, k)|^2$$

$$P_{Mest}(t, b) = \sum_k |M_{est}(t, b, k)|^2$$

$$P_M(t, b) = \sum_k |M(t, k)|^2$$

A spectral-match goodness factor can be defined as:

$$Q(t, b) = \frac{E_{mic}(t, b)}{P_{Mest}(t, b) + P_M(t, b)}$$

This value is always in the range 0 to 0.5. For each value of time t, subsystem 111 preferably keeps track of four values of block index b which correspond to the four smallest values of Q(t,b).

The goodness factor, Q(t,b), is useful to help determine which smoothed gains best maps to M t, k). The lower the goodness factor, the better the mapping. Thus, the system identifies the block index b (of the block in delay line 102) that corresponds to the smallest value of Q(t, b). For a given time t, this is denoted as $b_{best}(t)$. This block index, $b_{best}(t)$, provides a coarse estimate of the latency, and is the result of the above-mentioned first (coarse) stage of latency estimation by subsystem 93. The coarse estimate of latency is provided to subsystems 106 and 107.

Preferably, after subsystem 111 has determined the block index $b_{best}(t)$, subsystem 111 performs thresholding tests to determine whether smoothed gains $H_s(t, b_{best}(t), k)$, corresponding to the block having index $b_{best}(t)$, should be contemplated as a candidate set of gains for computing a refined estimate of latency (i.e., for updating a previously determined refined estimate of the latency). If the tests determine that all thresholding conditions are met, the whole block from which the gains $H_s(t, b_{best}, k)$ are determined is considered a "good" (correct) block, and the value $b_{best}(t)$ and gains $H_s(t, b_{best}, k)$ are used (in subsystems 105, 106, and 107) to update a previously determined refined estimate of the latency (e.g., to determine a new refined estimate $L_{med}(t)$). If at least one of the thresholding conditions is not met, a previously determined refined estimate of latency is not updated. A previously determined refined estimate of latency is updated (e.g., as described below) if the tests indicate that the chosen playback block (having index $b_{best}(t)$) and its associated mapping (i.e., $H_s(t, b_{best}(t), k)$) is highly likely to be the correct block that best maps to microphone block M(t, k). After a tuning process, we have determined that three thresholding tests are preferably applied to determine whether the following three thresholding conditions are met:

1) $Q(t, b_{best}(t))<0.4$. This indicates that the gains $H_s(t, b_{best}, k)$ for the block provides a good mapping between the M(t, k) and the playback data. In alternative embodiments, some threshold value other than 0.4 is used as the threshold (as noted above, $Q(t, b_{best}(t))$ always has a value in the range 0 to 0.5);

2)

$$\frac{Q(t, b_{best}(t))}{Q(t, b_{4th_best})} < 0.4,$$

where $b_{4th_best}$ denotes the block index b which corresponds to the $4^{th}$ smallest Q(t, b). As noted above, for each value of time t, the system keeps track of the four values of block index b which correspond to the four smallest values of Q(t, b), and thus can determine $b_{4th_best}$ for each time t. In alternative embodiments, some threshold value other than 0.4 is used as the threshold. If a sinusoidal input is played through the speaker, we have found find that many of the playback blocks map well to M(t, k). To account for this scenario and other similar scenarios, the noted second condition ensures that the chosen mapping (the mapping corresponding to $b_{best}$) is a much better mapping than that for any other block index b. This ensures that the smallest goodness factor is quite small in comparison to any other goodness factor. It is reasonable to expect the second smallest and third smallest values of goodness factor Q(t,b) to be similar to the smallest value of the goodness factor, as these could correspond to neighboring blocks. However the $4^{th}$ smallest goodness factor Q(t,b) should be relatively large in comparison to the smallest, and in these cases $H_s(t, b_{best}(t), k)$ is likely to be a correct mapping; and 3) $P_{Mest}(t, b_{best}(t)) > \varpi$, where $\varpi$ is a control parameter (whose value may be selected, e.g., as a result of tuning, based on the system and contemplated use case). If $P_{Mest}$ (the above-described power estimate of the estimated signal $M_{est}$) is too low, it is likely that the playback signal is too small for use to reliably and accurately update a latency estimate. Conversely, if the power of the estimated signal is high (e.g., above the threshold), it is likely that $H_s(t, b_{best}(t), k)$ is a correct mapping.

If the three above-indicated thresholding conditions are satisfied, a parameter $\zeta(t)$ is set to equal 1. In this case, the system updates (e.g., as described below) a previously determined refined (sample-accurate) latency estimate based on the coarse estimate $b_{best}(t)$ and the gains $H_s(t, b_{best}(t), k)$. Otherwise the parameter $\zeta(t)$ is set to have the value 0. In this case, a previously determined refined latency estimate is used (e.g., as described below) as the current refined latency estimate, $L_{med}(t)$.

We next describe details of an example embodiment of determination of a refined latency estimate $L_{med}(t)$, which is performed in subsystems 105, 106, and 107 of FIG. 2.

The typical analysis modulation of a decimated DFT filterbank has the form:

$$X(t, k) = \sum_{n=0}^{N-1} p(n)x(tM - n)e^{\frac{-j2\pi(n+\alpha)(k+\beta)}{K}}$$

where α and β are constants, K is the number of frequency bands, M is the decimation factor or "stride" of the filterbank, N is the length of the filter and p(n) are the coefficients of the filter. A key aspect of some embodiments of the invention is recognition that the computed gain coefficients $H_s(t, b, k)$ which map one block of complex, frequency domain audio data to another can also be seen as an approximation to the transformed coefficients of an impulse response that would have performed a corresponding operation in the time domain, assuming a sensible implementation of each time-domain-to-frequency-domain transform filter (e.g., STFT or NPR DFT filterbank) employed to generate the frequency-domain data from which the latency is estimated. If the gains $H_s(t, b_{best}(t), k)$ are determined to be highly likely to provide a good mapping between the two audio data streams (e.g., by applying the three thresholding tests described herein), the system can calculate a new instantaneous latency estimate (for updating a previously determined instantaneous latency estimate) by processing the identified gain values ($H_s(t, b_{best}(t), k)$, which correspond to the values G(t,k) in the equation) through an inverse transformation of the following form:

$$g(t, n) = \sum_{k=0}^{K-1} G(t, k) e^{\frac{j2\pi n(k+\beta)}{K}}$$

and identifying the location of the peak value (i.e., the largest of the values g(t,n) for the time t).

This step of determining the new instantaneous latency estimate works well even when many of the values of G(t, k) are zero, as is typically the case as a result of the data reduction step (e.g., performed in blocks 103 and 103A of the FIG. 2 embodiments) include in typical embodiments so long as the chosen frequency bins are chosen such that they are not harmonically related (as described below).

Thus, a typical implementation of subsystem 105 (of FIG. 2) of the inventive system identifies a peak value (the "arg max" term of the following equation) of an inverse-transformed version of the gains $H_s(t, b_{best}(t), k)$ for the delayed block having delay time $b_{best}(t)$, in a manner similar to that which would typically be done in a correlation-based delay detector. In subsystem 106, the delay time $b_{best}(t)$ is added to this peak value, to determine a refined latency estimate L(t), which is a refined version of the coarse latency estimate $b_{best}(t)$, as in the following equation:

$$L(t) = \underset{n \in \left[-\frac{M}{2}-\gamma, \frac{M}{2}+\gamma\right]}{\operatorname{argmax}} \left| \sum_{k=0}^{K-1} H_s(t, b_{best}(t), k) e^{\frac{j2\pi(n)(k+\beta)}{K}} \right| - M b_{best}(t)$$

where M is the decimation factor of the filterbank, and K is the number of complex sub-bands of the filterbank. The summation over k is the equation of an inverse complex modulated filterbank being applied to the estimated gain mapping data in $H_{s_}$ (many values of k need not be evaluated because $H_s$ will be zero based on the data-reduction). The value of β must match the corresponding value for the analysis filterbank, and this value is typically zero for DFT modulated filterbanks (e.g., STFT), but other implementations may have a different value (for example 0.5) which changes the center frequencies of the frequency bins. The parameter γ is some positive constant which is used to control how far away from the central peak the system may look.

The estimate L(t) is provided to subsystem 107. When ζ(t) is 1 (as determined by the above-described thresholding tests), subsystem 107 inserts L(t) into a delay line of length X (where X=40 in typical embodiments, where this length has been determined using a tuning process assuming 20 millisecond audio blocks). Subsystem 107 finds the median of all the data in this delay line. This median, denoted herein as $L_{med}(t)$, is the final (refined) estimate of the latency, which is reported to subsystem 109. When ζ(t) is zero, a previously generated median value is reported as the final estimate of the latency: $L_{med}(t)=L_{med}(t-1)$.

In typical operation, it is expected that the latency estimated by the FIG. 2 system will be fairly constant over time and over many iterations of latency estimation subsystem 93. If this is not the case, it is expected that either the environment and/or operating conditions of the system is/are undergoing a change; or the system was unable to accurately calculate a latency. To communicate the latter to users of the latency estimation subsystem, subsystem 107 preferably generates and outputs (e.g., to subsystem 109) at least one confidence metric (i.e., all or some of below-mentioned values $C_1(t)$, $C_2(t)$, or $C(t)=C_1(t)C_2(t)$).

We next describe in greater detail an example of generation of confidence metrics $C_1(t)$, $C_2(t)$, and $C(t)=C_1(t)C_2(t)$, which are heuristic confidence metrics in the sense that each is determined using at least one heuristically determined parameter. As noted, subsystem 107 implements a delay line to determine the median, $L_{med}(t)$, of a number of recently determined values L(t). In the example, subsystem 107 counts the number of difference values DV (each of which is the difference between a different one of the values in the delay line, and the most recent value of the median, $L_{med}(t)$) which exceed a predetermined value, $N_{sim}$ (e.g., $N_{sim}=10$, which has been determined by a tuning process to be a suitable value in typical use cases). The value DV (the number of latencies that are similar to the most recent value of the median, $L_{med}(t)$) is divided by the total number of values in the delay line, and the result is stored as the confidence metric $C_1(t)$, which corresponds to how many outliers are present in the delay line. If ζ(t) is zero, a previously determined value of this confidence metric is employed: $C_1(t)=C_1(t-1)$.

It is desirable that the system indicate high confidence, if the system has measured the same latency over a period of time that is considered significant. For example, in the case of a duplex communication device, the length of one Harvard sentence may be considered to be significant. If the system sporadically measures a different latency during this period of time, it is typically undesirable that the system quickly indicate a loss of confidence. Preferably, the system indicates lowered confidence only when the system has consistently, e.g., 80% of the time, estimated a different latency than the most recent estimate $L_{med}(t)$. Furthermore, when the operating conditions have changed from far-end only/double talk to near-end only, there is no playback audio data to use to estimate latency, so the system should neither lose nor gain confidence on the calculated $L_{med}(t)$.

To achieve all this, subsystem 107 generates (and outputs) a new confidence metric $C_2(t)$, whose value slowly increases over time when subsystem 107 determines many measured latency values that are the same and quickly decreases when they are not. An example of metric $C_2(t)$ is provided below. It should be appreciated that other ways of defining the metric $C_2(t)$ are possible. The example of metric $C_2(t)$, which assumes that the system keeps track of the above-defined parameter ζ(t), is as follows:

If ζ(t)=1, and if distance value D is less than $N_{sim}$, where the distance value D is the difference between the most recently determined value $L_{med}(t)$ and the X most recently determined value of L(t) (e.g., $N_{sim}=10$, as in the example described above), $C_2(t)=C_2(t-1)+a(1-C_2(t-1))$ where $a=0.3$ in a typical implementation.

Otherwise, if $P_{Mest}(t, b_{best}(t))\leq 1e^{-5}$ and $C_1(t)\leq 0.899$, $C_2(t)=C_2(t-1)$ Otherwise, if $C_2(t-1)>0.98$ and $C_1(t)>0.9$, $C_2(t)=0.98$ Otherwise, if $C_2(t-1)>0.5$, $C_2(t)=C_2(t-1)-a(1-C_2(t-1))$, where $a=0.03$ in a typical implementation.

Otherwise, $C_2(t)=(1-a)C_2(t-1)$, where $a=0.03$ in a typical implementation.

In the example, $C_2(t)$ is defined such that it logarithmically rises when indicators suggest that the system should be more confident, where the logarithmic rate ensures that $C_2(t)$ is bounded by 1. However, when indicators suggest the system should lose confidence, the metric indicates less confidence, in a slow logarithmic decay, so that it doesn't indicate loss of confidence due to any sporadic measurements. However if $C_2(t)$ reduces to 0.5, we switch to an exponential decay for two reasons: so that $C_2(t)$ is bounded by zero; and because if $C_2(t)$ has reached to 0.5, then the system is likely to be in a new operating condition/environment and so it should quickly lose confidence in $L_{med}(t)$. In the example, extra conditions are included for the cases when both $C_2(t-1)>0.98$ and $C_1(t)>0.9$. This is because logarithmic decay is quite slow at the start, so that the example jump-starts a loss of confidence by setting $C_2(t)$ to 0.98. We contemplate that there are other ways to achieve the goal of metric $C_2(t)$, which is achieved by the described example.

A third confidence metric which may be generated (and output by) subsystem 107 is:

$C(t)=C_1(t)C_2(t)$

In some implementations, subsystem 107 generates (and outputs) only the confidence metric C(t), or at least one but not all of metrics $C_1(t)$, $C_2(t)$, and $C(t)=C_1(t)C_2(t)$). In other implementations, subsystem 107 generates (and outputs) all of metrics $C_1(t)$, $C_2(t)$, and C(t)=C1(t)C2(t)).

We next describe in greater detail examples of data reduction (e.g., in subsystems 103 and 103A of the FIG. 2 system) implemented in some embodiments of the inventive latency estimation method and system. For example, the data reduction may select only a small subset (e.g. 5%) of the frequency bins (having indices k) of the audio data streams from which the latency is estimated, starting at one low value of index k (which is a prime number) and choosing the rest of the selected indices k to be prime numbers. As previously mentioned, some embodiments of the inventive system operate only on a subset of sub-bands of the audio data streams, i.e., there are only certain values of index k for which gains $H_s(t, b_{best}(t), k)$ are computed. For values of k which the system has chosen to ignore (to improve performance), the system can set the gains $H_s(t, b_{best}(t), k)$ to zero.

As noted, the gains coefficients $H_s(t, b, k)$ which map one block of the complex audio data to another (in the frequency domain, in accordance with the invention) are typically an approximation to the transformed coefficients of the impulse response that would have performed that operation in the time domain. The selected subset of values k should be determined to maximize the ability of the inverse transform (e.g., that implemented in subsystem 105 of FIG. 2) to identify peaks in the gain values $H_s(t, b_{best}(t), k)$, since the gain values are typically peaky-looking data (which is what we would expect an impulse response to look like). It can be demonstrated that it is not optimal to operate on a group of consecutive values of k. Thus, typical embodiments of the inventive latency estimation operate on a selected subset of roughly 5% of the total number of transformed sub-bands, where those sub-bands have prime number indices, and where the first (lowest frequency) selected value is chosen to be at a frequency that is known to be reproducible by the relevant loudspeaker (e.g., speaker 91 of the FIG. 2 system).

Figure 3:
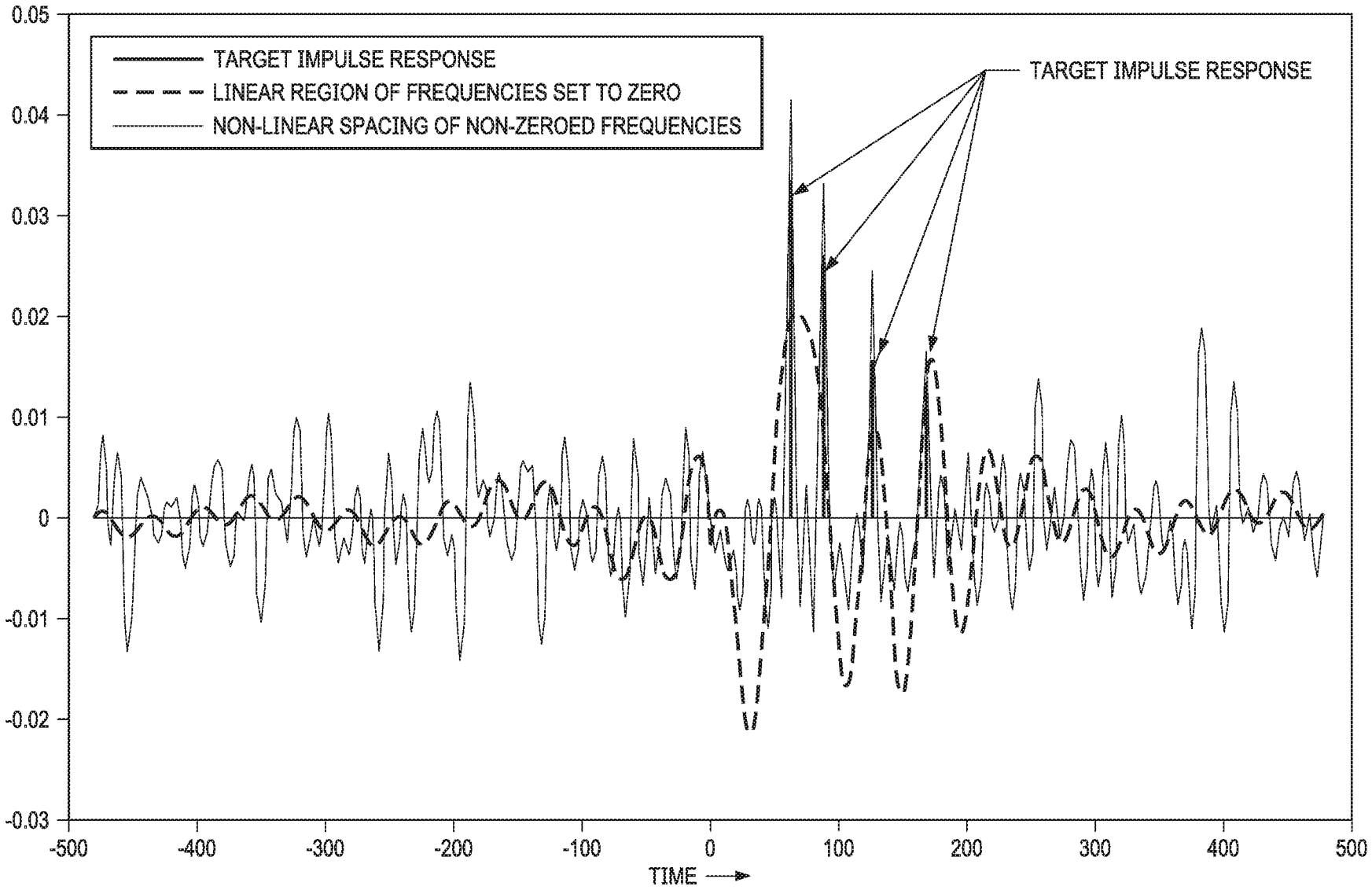
FIG. 3 is a plot illustrating performance resulting from data reduction which selects a region of consecutive frequency bins, k, versus data reduction (in accordance with some embodiments of the invention) which selects prime numbered frequency bin values k.

FIG. 3 is a plot (with system output indicated on the vertical axis, versus time, t, indicated on the horizontal axis) illustrating performance resulting from data reduction which selects a region of consecutive values of k, versus data reduction which implements the preferred selection of prime numbered frequency bin values k. The target impulse response (a fictitious impulse response with a peak at t=64) corresponds to desired characteristics of the inverse transform to be implemented by subsystem 105 of FIG. 2. The plot labeled "Non-linear spacing of selected (non-zeroed) frequencies" is an example output of the inverse transform implemented by subsystem 105, operating only on gains in 5% of the full set of frequency bins (with the gains for the non-selected bins being zeroed), where the selected bins have prime numbered frequency bin values k. This plot has peaks which are (desirably) aligned with the peaks of the target impulse response.

The plot labeled "Linear region of zeroed frequencies" is an example output of the inverse transform implemented by subsystem 105, operating only on gains in 5% of the full set of frequency bins (with the gains for the non-selected bins being zeroed), where the selected bins include a region of consecutively numbered frequency bin values k. This plot does not have peaks which are aligned with the peaks of the target impulse response, indicating that the corresponding selection of bins is undesirable.

Example Processes

Figure 4:
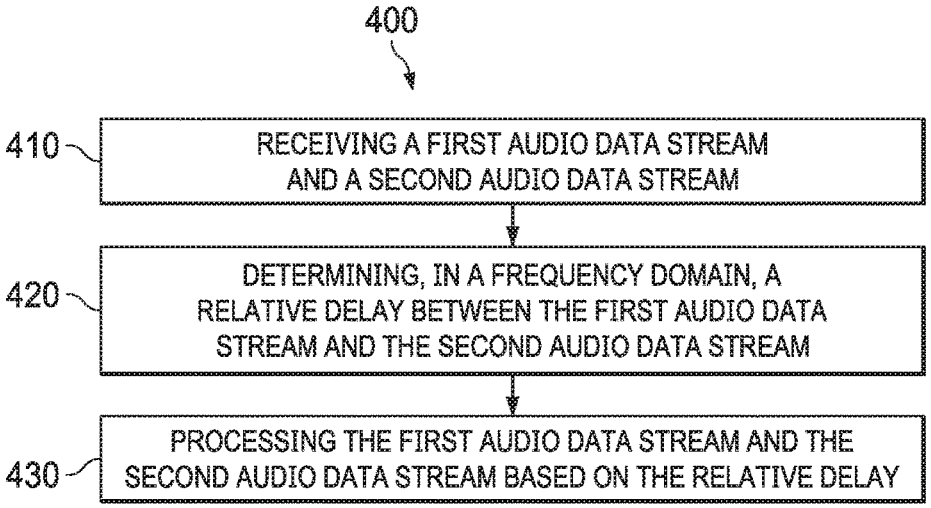
FIG. 4 is a flowchart of an example process of delay identification in a frequency domain.

FIG. 4 is a flowchart of an example process 400 of delay identification in a frequency domain. Process 400 can be performed by a system including one or more processors (e.g., a typical implementation of system 200 of FIG. 2 or system 2 of FIG. 1).

The system receives (410) a first audio data stream and a second audio data stream (e.g., those output from transform subsystems 108 and 108A of FIG. 2). The system determines (420), in a frequency domain, a relative time delay (latency) between the first audio data stream and the second audio data stream, in accordance with an embodiment of the inventive latency estimation method. The system also processes (430) the first audio data stream and the second audio data stream based on the relative delay (e.g., in preprocessing subsystem 109 of FIG. 2).

The first audio data stream can be originated from a first microphone (e.g., microphone 17 of FIG. 1 or microphone 90 of FIG. 2). The second audio data stream can be originated from a speaker tap, in the sense that the second audio stream results from "tapping out" a speaker feed, e.g., when the speaker feed is indicative of audio data that is about to be played out of the speaker. Determining operation 420 optionally includes calculating one or more confidence metrics (e.g., one or more of the heuristic confidence metrics described herein) indicative of confidence with which the relative delay between the first audio data stream and the second audio data stream is determined. The processing (430) of the first audio data stream and the second audio data stream may comprise correcting the relative delay in response to determining that the relative delay satisfies, e.g., exceeds, a threshold.

Example System Architecture

Figure 5:
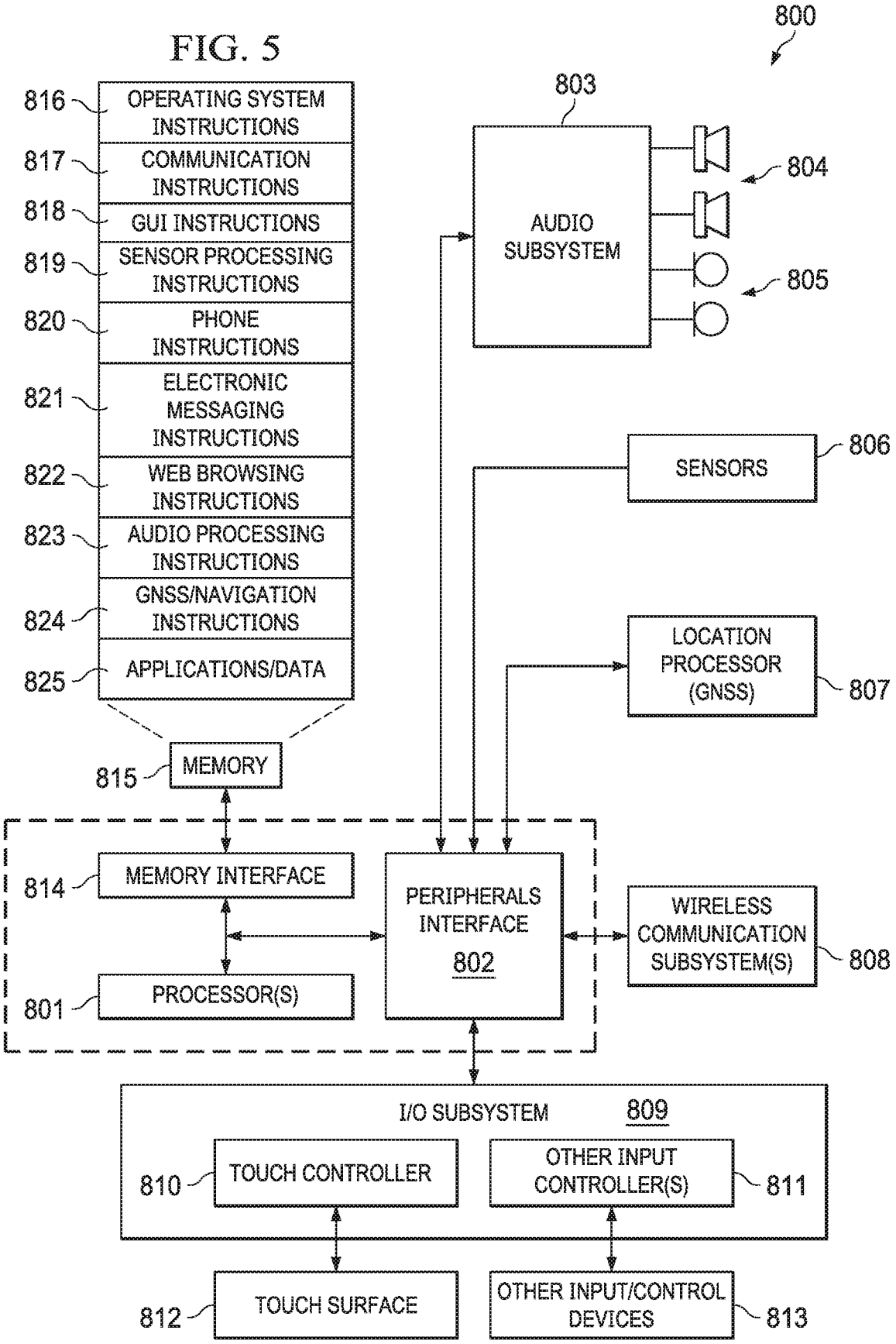
FIG. 5 is a mobile device architecture for implementing the features and processes described in reference to FIGS. 1-4.

FIG. 5 is a mobile device architecture for implementing some embodiments of the features and processes described herein with reference to FIGS. 1-4. Architecture 800 of FIG. 5 can be implemented in any electronic device, including but not limited to: a desktop computer, consumer audio/visual (AV) equipment, radio broadcast equipment, mobile devices (e.g., smartphone, tablet computer, laptop computer, wearable device). In the example embodiment shown, architecture 800 is for a smart phone and includes processor(s) 801, peripherals interface 802, audio subsystem 803, loudspeakers 804, microphones 805, sensors 806 (e.g., accelerometers, gyros, barometer, magnetometer, camera), location processor 807 (e.g., GNSS receiver), wireless communications subsystems 808 (e.g., Wi-Fi, Bluetooth, cellular) and I/O subsystem(s) 809, which includes touch controller 810 and other input controllers 811, touch surface 812 and other input/control devices 813. Other architectures with more or fewer components can also be used to implement the disclosed embodiments.

Memory interface 814 is coupled to processors 801, peripherals interface 802, and memory 815 (e.g., flash memory, RAM, and/or ROM). Memory 815 (a non-transitory computer-readable medium) stores computer program instructions and data, including but not limited to: operating system instructions 816, communication instructions 817, GUI instructions 818, sensor processing instructions 819, phone instructions 820, electronic messaging instructions 821, web browsing instructions 822, audio processing instructions 823, GNSS/navigation instructions 824 and applications/data 825. Audio processing instructions 823 include instructions for performing the audio processing described in reference to FIGS. 1-4 (e.g., instructions that, when executed by at least one of the processors 801, cause said at least one of the processors to perform an embodiment of the inventive latency estimation method or steps thereof).

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Aspects of some embodiments of the present invention include one or more of the following:

1. A method of processing audio data to estimate latency between a first audio signal and a second audio signal, comprising:

(a) providing a first sequence of blocks, M(t,k), of frequency-domain data indicative of audio samples of the first audio signal and a second sequence of blocks, P(t,k), of frequency-domain data indicative of audio samples of the second audio signal, where t is an index denoting a time of each of the blocks, and k is an index denoting frequency bin, and for each block P(t,k) of the second sequence, where t is an index denoting the time of said each block, providing delayed blocks, P(t,b,k), where b is an index denoting block delay time, where each value of index b is an integer number of block delay times by which a corresponding one of the delayed blocks is delayed relative to the time t;

(b) for each block, M(t,k), determining a coarse estimate, $b_{best}(t)$, of the latency at time t, including by determining gains which, when applied to each of the delayed blocks, P(t,b,k), determine estimates, $M_{est}(t,b,k)$, of the block M(t,k), and identifying one of the estimates, $M_{est}(t,b,k)$, as having a best spectral match to said block, M(t,k), where the coarse estimate, $b_{best}(t)$, has accuracy on the order of one of the block delay times; and (c) determining a refined estimate, R(t), of the latency at time t, from the coarse estimate, $b_{best}(t)$, and some of the gains, where the refined estimate, R(t), has accuracy on the order of an audio sample time.

2. The method of claim 1, wherein gains H(t,b,k) are the gains for each of the delayed blocks, P(t,b,k), wherein step (b) includes determining a heuristic unreliability factor, U(t,b,k), on a per frequency bin basis for each of the delayed blocks, P(t,b,k), and wherein each said unreliability factor, U(t,b,k), is determined from sets of statistical values, said sets including: mean values, $H_m(t,b,k)$, determined from the gains H(t,b,k) by averaging over two times; and variance values $H_v(t,b,k)$, determined from the gains H(t,b,k) and the mean values $H_m(t,b,k)$ by averaging over the two times.

3. The method of claim 1 or 2, wherein step (b) includes determining goodness factors, Q(t,b), for the estimates $M_{est}(t,b,k)$ for the time t and each value of index b, and determining the coarse estimate, $b_{best}(t)$, includes selecting one of the goodness factors, Q(t,b).

4. The method of any of claims 1-3, also including:

(d) applying thresholding tests to determine whether a candidate refined estimate of the latency should be used to update a previously determined refined estimate R(t) of the latency; and (e) using the candidate refined estimate to update the previously determined refined estimate R(t) of the latency only if the thresholding tests determine that thresholding conditions are met.

5. The method of claim 4, wherein step (d) includes determining whether a set of smoothed gains $H_s(t, b_{best}(t), k)$, for the coarse estimate, $b_{best}(t)$, should be considered as a candidate set of gains for determining an updated refined estimate of the latency.

6. The method of claim 4, wherein refined estimates R(t) of the latency are determined for a sequence of times t, from the sets of gains $H_s(t, b_{best}(t), k)$ which meet the thresholding conditions, and step (e) includes identifying a median of a set of X values as the refined estimate R(t) of latency, where X is an integer, and the X values include the most recently determined candidate refined estimate and a set of X−1 previously determined refined estimates of the latency.

7. The method of claim 4, also including determining a fourth best coarse estimate, $b_{4thbest}(t)$, of the latency at time t, and wherein:

step (b) includes determining goodness factors, Q(t,b), for the estimates $M_{est}(t,b,k)$ for the time t and each value of index b, and determining the coarse estimate, $b_{best}(t)$, includes selecting one of the goodness factors, Q(t,b), and step (d) includes applying the thresholding tests to the goodness factor $Q(t,b_{best})$ for the coarse estimate $b_{best}(t)$, the goodness factor $Q(t,b_{4thbest})$ for the fourth best coarse estimate, $b_{4thbest}(t)$, and the estimates $M_{est}(t,b_{best},k)$ for the coarse estimate, $b_{best}(t)$.

8. The method of any of claims 1-7, also including:

generating at least one confidence metric indicative of confidence in the accuracy of the refined estimate, R(t), of the latency.

9. The method of claim 8, wherein the at least one confidence metric includes at least one or more heuristic confidence metric.

10. The method of any of claims 1-9, also including:

processing at least some of the frequency-domain data indicative of audio samples of the first audio signal and the frequency-domain data indicative of audio samples of the second audio signal, including by performing time alignment based on the refined estimate, R(t), of the latency.

11. The method of any of claims 1-10, wherein the first audio signal is a microphone output signal, and the second audio signal is originated from a speaker tap.

12. A non-transitory computer-readable medium storing instructions that, when executed by at least one processor, cause the at least one processor to perform the method of any of claims 1-11.

13. A system for estimating latency between a first audio signal and a second audio signal, comprising:

at least one processor, coupled and configured to receive or generate a first sequence of blocks, M(t,k), of frequency-domain data indicative of audio samples of the first audio signal and a second sequence of blocks, P(t,k), of frequency-domain data indicative of audio samples of the second audio signal, where t is an index denoting a time of each of the blocks, and k is an index denoting frequency bin, and for each block P(t,k) of the second sequence, where t is an index denoting the time of said each block, providing delayed blocks, P(t,b,k), where b is an index denoting block delay time, where each value of index b is an integer number of block delay times by which a corresponding one of the delayed blocks is delayed relative to the time t, wherein the at least one processor is configured:

for each block, M(t,k), to determine a coarse estimate, $b_{best}(t)$, of the latency at time t, including by determining gains which, when applied to each of the delayed blocks, P(t,b,k), determine estimates, $M_{est}(t,b,k)$, of the block M(t,k), and identifying one of the estimates, $M_{est}(t,b,k)$, as having a best spectral match to said block, M(t,k), where the coarse estimate, $b_{best}(t)$, has accuracy on the order of one of the block delay times; and to determine a refined estimate, R(t), of the latency at time t, from the coarse estimate, $b_{best}(t)$, and some of the gains, where the refined estimate, R(t), has accuracy on the order of an audio sample time of the frequency-domain data.

14. The system of claim 13, wherein gains H(t,b,k) are the gains for each of the delayed blocks, P(t,b,k), and wherein the at least one processor is configured to:

determine the coarse estimate, $b_{best}(t)$, including by determining a heuristic unreliability factor, U(t,b,k), on a per frequency bin basis for each of the delayed blocks, P(t,b,k), where each said unreliability factor, U(t,b,k), is determined from sets of statistical values, said sets including: mean values, $H_m(t,b,k)$, determined from the gains H(t,b,k) by averaging over two times; and variance values $H_v(t,b,k)$, determined from the gains H(t,b,k) and the mean values $H_m(t,b,k)$ by averaging over the two times.

15. The system of claim 13 or 14, wherein the at least one processor is configured to determine the coarse estimate, $b_{best}(t)$, including by determining goodness factors, Q(t,b), for the estimates $M_{est}(t,b,k)$ for the time t and each value of index b, and wherein determining the coarse estimate, $b_{best}(t)$, includes selecting one of the goodness factors, Q(t,b).

16. The system of any of claims 13-15, wherein the at least one processor is configured to:

apply thresholding tests to determine whether a candidate refined estimate of the latency should be used to update a previously determined refined estimate R(t) of the latency; and use the candidate refined estimate to update the previously determined refined estimate R(t) of the latency only if the thresholding tests determine that thresholding conditions are met.

17. The system of claim 16, wherein the at least one processor is configured to apply the thresholding tests including by determining whether a set of smoothed gains $H_s(t, b_{best}(t), k)$, for the coarse estimate, $b_{best}(t)$, should be considered as a candidate set of gains for determining an updated refined estimate of the latency.

18. The system of claim 16, wherein the at least one processor is configured to determine refined estimates R(t) of the latency for a sequence of times t, from the sets of gains $H_s(t, b_{best}(t), k)$ which meet the thresholding conditions, and to use the candidate refined estimate to update the previously determined refined estimate R(t) of the latency including by identifying a median of a set of X values as a new refined estimate R(t) of latency, where X is an integer, and the X values include the most recently determined candidate refined estimate and a set of X−1 previously determined refined estimates of the latency.

19. The system of any of claims 16-18, wherein the at least one processor is configured to:

determine a fourth best coarse estimate, $b_{4thbest}(t)$, of the latency at time t;

determine the coarse estimate, $b_{best}(t)$, including by determining goodness factors, Q(t,b), for the estimates $M_{est}(t,b,k)$ for the time t and each value of index b, and determining the coarse estimate, $b_{best}(t)$, includes selecting one of the goodness factors, Q(t,b); and apply the thresholding tests to the goodness factor $Q(t, b_{best})$ for the coarse estimate $b_{best}(t)$, the goodness factor $Q(t,b_{4thbest})$ for the fourth best coarse estimate, $b_{4thbest}(t)$, and the estimates $M_{est}(t,b_{best},k)$ for the coarse estimate, $b_{best}(t)$.

20. The system of any of claims 13-19, wherein the at least one processor is configured to generate at least one confidence metric indicative of confidence in the accuracy of the refined estimate, R(t), of the latency.

21. The system of claim 20, wherein the at least one confidence metric includes at least one or more heuristic confidence metric.

22. The system of any of claims 13-21, wherein the at least one processor is configured to process at least some of the frequency-domain data indicative of audio samples of the first audio signal and the frequency-domain data indicative of audio samples of the second audio signal, including by performing time alignment based on the refined estimate, R(t), of the latency.

23. The system of any of claims 13-22, wherein the first audio signal is a microphone output signal, and the second audio signal is originated from a speaker tap.

Aspects of the invention include a system or device configured (e.g., programmed) to perform any embodiment of the inventive method, and a tangible computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto.

Some embodiments of the inventive system are implemented as a configurable (e.g., programmable) digital signal processor (DSP) or graphics processing unit (GPU) that is configured (e.g., programmed and otherwise configured) to perform required processing on audio signal(s), including performance of an embodiment of the inventive method or steps thereof. Alternatively, embodiments of the inventive system (or elements thereof) are implemented as a general purpose processor (e.g., a personal computer (PC) or other computer system or microprocessor, which may include an input device and a memory) which is programmed with software or firmware and/or otherwise configured to perform any of a variety of operations including an embodiment of the inventive method. Alternatively, elements of some embodiments of the inventive system are implemented as a general purpose processor, or GPU, or DSP configured (e.g., programmed) to perform an embodiment of the inventive method, and the system also includes other elements (e.g., one or more loudspeakers and/or one or more microphones). A general purpose processor configured to perform an embodiment of the inventive method would typically be coupled to an input device (e.g., a mouse and/or a keyboard), a memory, and a display device.

Another aspect of the invention is a computer readable medium (for example, a disc or other tangible storage medium) which stores code for performing (e.g., coder executable to perform) any embodiment of the inventive method or steps thereof.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method of processing audio data to estimate latency between a first audio signal and a second audio signal, comprising:

(a) providing a first sequence of blocks, M(t,k), of frequency-domain data indicative of audio samples of the first audio signal and a second sequence of blocks, P(t,k), of frequency-domain data indicative of audio samples of the second audio signal, where t is an index denoting a time of each of the blocks, and k is an index denoting frequency bin, and for each block P (t,k) of the second sequence, where t is an index denoting the time of said each block, providing delayed blocks, P (t,b,k), where b is an index denoting block delay time, where each value of index b is an integer number of block delay times by which a corresponding one of the delayed blocks is delayed relative to the time t;

(b) for each block, M(t,k), determining a coarse estimate, $b_{best}(t)$, of the latency at time t, including by determining gains which, when applied to each of the delayed blocks, P (t,b,k), determine estimates, $M_{est}(t,b,k)$, of the block M(t,k), and identifying one of the estimates, Mest(t,b,k), as having a best spectral match to said block, M(t,k), where the coarse estimate, $b_{best}(t)$, has accuracy on the order of one of the block delay times; and (c) determining a refined estimate, R(t), of the latency at time t, from the coarse estimate, $b_{best}(t)$, and one or more of the gains, where the refined estimate, R(t), has accuracy on the order of an audio sample time, wherein gains H(t, b,k) are the gains for each of the delayed blocks, P(t,b,k), wherein step (b) includes determining a heuristic unreliability factor, U(t, b,k), on a per frequency bin basis for each of the delayed blocks, P(t,b,k), and wherein each said unreliability factor, U(t,b,k), is determined from sets of statistical values, said sets including: mean values, $H_m(t,b,k)$, determined from the gains H(t, b,k) by averaging over two times; and variance values $H_v(t,b,k)$, determined from the gains H(t, b, k) and the mean values $H_m(t, b, k)$ by averaging over the two times.

2. The method of claim 1, wherein step (b) includes determining goodness factors, Q(t, b), for the estimates $M_{est}(t,b,k)$ for the time t and each value of index b, and determining the coarse estimate, $b_{best}(t)$, includes selecting one of the goodness factors, Q(t,b).

3. The method of claim 1, also including:

(d) applying thresholding tests to determine whether a candidate refined estimate of the latency should be used to update a previously determined refined estimate R(t) of the latency; and (e) using the candidate refined estimate to update the previously determined refined estimate R(t) of the latency only if the thresholding tests determine that thresholding conditions are met.

4. The method of claim 3, wherein step (d) includes determining whether a set of smoothed gains $H_s(t, b_{best}(t), k)$, for the coarse estimate, $b_{best}(t)$, should be considered as a candidate set of gains for determining an updated refined estimate of the latency.

5. The method of claim 4, wherein refined estimates R(t) of the latency are determined for a sequence of times t, from the sets of gains $H_s(t, b_{best}(t), k)$ which meet the thresholding conditions, and step (e) includes identifying a median of a set of X values as the refined estimate R(t) of latency, where X is an integer, and the X values include the most recently determined candidate refined estimate and a set of X-1 previously determined refined estimates of the latency.

6. The method of claim 3, also including determining a fourth best coarse estimate, $b_{4thbest}(t)$, of the latency at time t, and wherein:

step (b) includes determining goodness factors, Q(t, b), for the estimates $M_{est}(t,b,k)$ for the time t and each value of index b, and determining the coarse estimate, $b_{best}(t)$, includes selecting one of the goodness factors, Q(t, b), and step (d) includes applying the thresholding tests to the goodness factor $Q(t, b_{best})$ for the coarse estimate $b_{best}(t)$, the goodness factor $Q(t,b_{4thbest})$ for the fourth best coarse estimate, $b_{4thbest}(t)$, and the estimates $M_{est}(t,b_{best},k)$ for the coarse estimate, $b_{best}(t)$.

7. The method of claim 1, also including:

generating at least one confidence metric indicative of confidence in the accuracy of the refined estimate, R(t), of the latency.

8. The method of claim 7, wherein the at least one confidence metric includes at least one or more heuristic confidence metric.

9. The method of claim 1, also including:

processing one or more blocks of the frequency-domain data indicative of audio samples of the first audio signal and the frequency-domain data indicative of audio samples of the second audio signal, including by performing time alignment based on the refined estimate, R(t), of the latency.

10. The method of claim 9, wherein the processing includes performing echo cancellation.

11. The method of claim 1, wherein the first audio signal is a microphone output signal, and the second audio signal is originated from a speaker tap.

12. A non-transitory computer-readable medium storing instructions that, when executed by at least one processor, cause the at least one processor to perform the method of claim 1.

13. A system for estimating latency between a first audio signal and a second audio signal, comprising:

at least one processor, coupled and configured to receive or generate a first sequence of blocks, M(t,k), of frequency-domain data indicative of audio samples of the first audio signal and a second sequence of blocks, P(t,k), of frequency-domain data indicative of audio samples of the second audio signal, where t is an index denoting a time of each of the blocks, and k is an index denoting frequency bin, and for each block P(t,k) of the second sequence, where t is an index denoting the time of said each block, providing delayed blocks, P(t,b,k), where b is an index denoting block delay time, where each value of index b is an integer number of block delay times by which a corresponding one of the delayed blocks is delayed relative to the time t, wherein the at least one processor is configured:

for each block, M(t,k), to determine a coarse estimate, $b_{best}(t)$, of the latency at time t, including by determining gains which, when applied to each of the delayed blocks, P(t,b,k), determine estimates, $M_{est}(t,b,k)$, of the block M(t,k), and identifying one of the estimates, $M_{est}(t,b,k)$, as having a best spectral match to said block, M(t,k), where the coarse estimate, $b_{best}(t)$, has accuracy on the order of one of the block delay times; and to determine a refined estimate, R(t), of the latency at time t, from the coarse estimate, $b_{best}(t)$, and one or more of the gains, where the refined estimate, R(t), has accuracy on the order of an audio sample time, wherein gains H(t, b,k) are the gains for each of the delayed blocks, P(t,b,k), and wherein the at least one processor is configured to:

determine the coarse estimate, $b_{best}(t)$, including by determining a heuristic unreliability factor, U(t,b,k), on a per frequency bin basis for each of the delayed blocks, P(t,b,k), where each said unreliability factor, U(t,b,k), is determined from sets of statistical values, said sets including: mean values, $H_m(t,b,k)$, determined from the gains H(t, b,k) by averaging over two times; and variance values $H_v(t, b,k)$, determined from the gains H(t, b,k) and the mean values $H_m(t, b,k)$ by averaging over the two times.

14. The system of claim 13, wherein the at least one processor is configured to determine the coarse estimate, $b_{best}(t)$, including by determining goodness factors, Q(t,b), for the estimates $M_{est}(t,b,k)$ for the time t and each value of index b, and wherein determining the coarse estimate, $b_{best}(t)$, includes selecting one of the goodness factors, Q(t,b).

15. The system of claim 13, wherein the at least one processor is configured to:

apply thresholding tests to determine whether a candidate refined estimate of the latency should be used to update a previously determined refined estimate R(t) of the latency; and use the candidate refined estimate to update the previously determined refined estimate R(t) of the latency only if the thresholding tests determine that thresholding conditions are met.

16. The system of claim 15, wherein the at least one processor is configured to apply the thresholding tests including by determining whether a set of smoothed gains $H_s(t, b_{best}(t), k)$, for the coarse estimate, $b_{best}(t)$, should be considered as a candidate set of gains for determining an updated refined estimate of the latency.

17. The system of claim 15, claim 16, wherein the at least one processor is configured to determine refined estimates R(t) of the latency for a sequence of times t, from the sets of gains $H_s(t, b_{best}(t), k)$ which meet the thresholding conditions, and to use the candidate refined estimate to update the previously determined refined estimate R(t) of the latency including by identifying a median of a set of X values as a new refined estimate R(t) of latency, where X is an integer, and the X values include the most recently determined candidate refined estimate and a set of X-1 previously determined refined estimates of the latency.

18. The system of claim 15, wherein the at least one processor is configured to:

determine a fourth best coarse estimate, $b_{4thbest}(t)$, of the latency at time t;

determine the coarse estimate, $b_{best}(t)$, including by determining goodness factors, Q(t,b), for the estimates $M_{est}(t,b,k)$ for the time t and each value of index b, and determining the coarse estimate, $b_{best}(t)$, includes selecting one of the goodness factors, Q(t,b); and apply the thresholding tests to the goodness factor $Q(t, b_{best})$ for the coarse estimate $b_{best}(t)$, the goodness factor $Q(t, b_{4thbest})$ for the fourth best coarse estimate, $b_{4thbest}(t)$, and the estimates $Mest(t,b_{best},k)$ for the coarse estimate, $b_{best}(t)$.

19. The system of claim 13, wherein the at least one processor is configured to:

generate at least one confidence metric indicative of confidence in the accuracy of the refined estimate, R(t), of the latency.

20. The system of claim 19, wherein the at least one confidence metric includes at least one or more heuristic confidence metric.

21. The system of claim 13, wherein the at least one processor is configured to:

process one or more blocks of the frequency-domain data indicative of audio samples of the first audio signal and the frequency-domain data indicative of audio samples of the second audio signal, including by performing time alignment based on the refined estimate, R(t), of the latency.

22. The system of claim 21, wherein the at least one processor is configured to implement a discrete Fourier transform (DFT) modulated filterbank to perform echo cancellation.

23. The system of claim 13, wherein the first audio signal is a microphone output signal, and the second audio signal is originated from a speaker tap.

* * * * *